US011745086B1

(12) United States Patent
Palmer

(10) Patent No.: US 11,745,086 B1
(45) Date of Patent: Sep. 5, 2023

(54) ONEWHEEL SUPPORT SYSTEMS AND APPARATUS

(71) Applicant: AO23 Ltd., Denver, CO (US)

(72) Inventor: Koltyn Chiaro Palmer, Denver, CO (US)

( * ) Notice: Subject to any disclaimer, the term of this patent is extended or adjusted under 35 U.S.C. 154(b) by 0 days.

(21) Appl. No.: 17/656,647

(22) Filed: Mar. 27, 2022

Related U.S. Application Data

(60) Provisional application No. 63/182,293, filed on Apr. 30, 2021, provisional application No. 63/200,776, filed on Mar. 28, 2021.

(51) Int. Cl.
*A63C 17/26* (2006.01)
*A63C 17/01* (2006.01)

(52) U.S. Cl.
CPC ..... *A63C 17/014* (2013.01); *A63C 2203/40* (2013.01)

(58) Field of Classification Search
CPC ..... A63C 17/06; A63C 17/08; A63C 17/014; A63C 17/262; A63C 2203/40
See application file for complete search history.

(56) References Cited

U.S. PATENT DOCUMENTS

| | | | | |
|---|---|---|---|---|
| 5,484,312 | A * | 1/1996 | Zepeda | B63B 32/45 441/74 |
| 5,544,919 | A * | 8/1996 | Tinkler | A63C 17/01 441/75 |
| 6,193,276 | B1 * | 2/2001 | Sottile | A63C 17/01 280/87.042 |
| 6,368,173 | B1 * | 4/2002 | Runyan | B63B 32/47 280/611 |
| 9,211,470 | B2 * | 12/2015 | Bigler | B62J 50/22 |
| 10,682,565 | B1 * | 6/2020 | Woolson | A63C 17/014 |
| 2002/0140195 | A1 * | 10/2002 | Lumb | A63C 17/26 280/87.041 |
| 2016/0129337 | A1 * | 5/2016 | Weber | A63C 17/015 280/727 |
| 2019/0381390 | A1 * | 12/2019 | Wendelschafer | A63C 17/01 |
| 2020/0030684 | A1 * | 1/2020 | Corvello | A63C 17/262 |
| 2021/0023437 | A1 * | 1/2021 | Woolson | A63C 17/262 |

* cited by examiner

*Primary Examiner* — Brian L Swenson
(74) *Attorney, Agent, or Firm* — FisherBroyles, LLP; Craig W. Mueller

(57) ABSTRACT

Apparatus and systems are provided that enhance the use of a one wheel skateboard. Some of the apparatus described provide lateral surfaces that engage outer portions of a user's feet. Other apparatus facilitate the engagement of common snowboard bindings to a one wheel skateboard, thereby widening the spectrum of tricks that can be performed.

20 Claims, 12 Drawing Sheets

ONEWHEEL SUPPORT SYSTEMS AND APPARATUS

This application claims the benefit of U.S. Provisional Patent Application Ser. No. 63/200,776, filed Mar. 28, 2021, the entirety of which is incorporated by reference herein.

This application claims the benefit of U.S. Provisional Patent Application Ser. No. 63/182,293, filed Apr. 30, 2021, the entirety of which is incorporated by reference herein.

FIELD OF THE INVENTION

Embodiments of the present invention relate to enabling the functionality of a self-balancing single-wheel electric board by way of leverage. Other embodiments of the present invention relate to electric board sports/vehicles.

BACKGROUND OF THE INVENTION

Motorized single-wheel or center-oriented wheeled boards (often referred to as "onewheels") are described in U.S. Pat. Nos. 9,908,580 and 10,369,453, which are incorporated by reference herein.

There is currently not an option for additional foot retention that engages the lateral, medial, anterior, and/or posterior parts of the legs while using a natural or widened riding stance on a onewheel.

There is no way to apply physical energy to gain altitude to perform a jump on a factory-standard self-balancing onewheel electric board, wherein both the rider and the board lift off the ground without the use of the hands or a leash connected to the rider whilst riding on a flat surface.

Although a factory-supplied front footpad may contain a slight curve, it does not provide substantial foot support when riding over rugged terrain for an extended duration.

The front footpad on a self-balancing onewheel contains the critical sensor component, resulting in a limitation of aftermarket manufacturing of footpads/footpad accessories designed for increased control.

Some aftermarket products provide leverage to leap into the air but primarily rely upon the medial and anterior parts of the legs while the riding stance is narrowed to execute a jump.

Thus, it is a long-felt need to provide enhanced foot stability while using a onewheel to enhance its functionality. The following disclosure describes a device designed to be used to provide at least one functional enhancement while riding, including but not limited to improved "carvability," ability to leap into the air without the use of the hands, increased foot retention, reduced foot slippage, enabled activation of applicable muscle groups, tighter and quicker pivot turns, and ability to utilize any of many leverage points to turn while in the air. Embodiments of the invention may include a base unit, base plate, mounting bracket, components that may connect to other accessories or parts of the board, and other smaller components, such as fixing or closure levers.

SUMMARY OF THE INVENTION

Embodiments of the present invention seek to provide a solution to the problems mentioned above by providing a lateral leverage device, which, when mounted to a onewheel, prevents the user's feet from slipping from a footpad normally provided on the upper surface of the onewheel. Accordingly, the contemplated device allows the rider to maintain a desired position on the onewheel in a manner that will allow them to continue normal operation, initiate a vertical lift maneuver, etc. The device accepts axial pressure, i.e., along the onewheel's longitudinal axis, from the user's foot/feet, which transmits energy to the frame for more controlled steering and allows for a natural or slightly widened riding stance.

The present invention enhances functional enhancement while riding by containing the user's foot on the onewheel's standing surface, while allowing for user-determined position and range adjustments. Carvability and responsiveness are also improved, resulting from the ability to distinctly leverage heel and toe movements. Jumps may also be preloaded for increased distance or aerial lift while controlling the tilt of the board while in the air. Accordingly, board directional momentum is aligned with the rider's midair motion.

The invention may include a base unit, base plate, mounting bracket, components which may connect to other accessories or parts of the board, and other smaller components, such as straps, levers, rods, bars, cam recording mounts, handles, etc.

The device has holes allowing for mounting to the self-balancing single-wheel electric board through existing bolt inserts in the rails, although it is not limited to this method of mounting.

The device consists of two or more sides.

Channels, inserts, tapped material, bends, curves, or otherwise transition of material(s) is made to allow for attachment connections or structural integrity.

The vertical planes of the side(s) of the device may be shaped to include channels and/or bolt inserts, may be flat without any cutout, may be reduced and/or vary in height, or may take on another form.

The device may consist of or exist in more than one material, so as to retain structural integrity while reducing the potential of damage to the rider's shoes or feet.

It is one aspect of some embodiments of the present invention to provide a device associated a single wheel motorized board having a front edge, a wheel portion, and a rear edge, comprising: a lower portion having an upper surface configured to interconnect to the front edge or rear edge of the board; a web interconnected to the lower portion, the web having an inward surface configured to be located adjacent to the front edge or rear edge of the board and adapted to engage an outer portion of a user's foot; and an upper portion having an inner edge extending towards the wheel portion of the board and generally perpendicular to the web.

It is another aspect of some embodiments of the present invention to provide a one wheel, comprising: a rear edge, first lateral toe-side, a lateral heal-side edge defining an upper surface and a lower surface; a single wheel positioned in an opening provided at the midpoint of the upper surface and the lower surface, the wheel having lateral surfaces corresponding to lateral heal-side and toe-side edges of the onewheel; a front foot retention member associated with the front edge, comprising: a lower portion having an upper surface configured to interconnect to the front edge of the onewheel, a web interconnected to the lower portion, the web having an inward surface configured to be located adjacent to the front edge of the onewheel and adapted to engage an outer portion of a user's first foot, and an upper portion having an inner edge extending towards the wheel, the upper portion having a lower surface that faces the upper surface of the onewheel; a rear foot retention member associated with the rear edge, comprising: a lower portion having an upper surface configured to interconnect to the rear edge of the onewheel, a web interconnected to the lower portion, the web having an inward surface configured to be located adjacent to the rear edge of the onewheel and adapted to engage an outer portion of a user's second foot, and an upper portion having an inner edge extending towards the wheel, the upper portion having a lower surface that faces the upper surface of the onewheel; wherein application of a force onto the lower surface of the upper portion of the front foot retention member while pressing down on a rear portion of the onewheel adjacent to the rear edge rotates the front edge of the onewheel upwardly; wherein application of a force onto the lower surface of the upper portion of the rear foot retention member while pressing down on a front portion of the onewheel adjacent to the front edge rotates the front edge of the onewheel upwardly; and wherein application of a force onto the lower surfaces of the upper portions of the front and rear foot retention members will initiate a vertical lift maneuver.

It is still yet another aspect of some embodiments of the present invention to provide a device associated with an electrically powered, self-balancing, sideways-operated single-wheel motorized board having a front portion, a wheel portion, and a rear portion, comprising: a bottom flange having an upper surface configured to interconnect to the front portion or rear portion of the one wheel; a web interconnected on one end to the bottom flange, the web having an inner surface configured to be located adjacent to the front portion or rear portion of the one-wheel board and adapted to engage the outer portion of a user's foot; and a top flange interconnected to the web at an end opposite to the bottom flange, the top flange having an edge extending inward toward the wheel portion of the board.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present invention are possible utilizing, alone or in combination, as set forth above and/or described in the accompanying figures and/or in the description herein below.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and drawing figures are to be understood as being approximations which may be modified in all instances as required for a particular application of the novel assembly and method described herein.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description and in the appended drawing figures.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

FIG. 7 is a bottom perspective view showing an optional pad interconnected to the device of FIG. 1.

Figure 1:
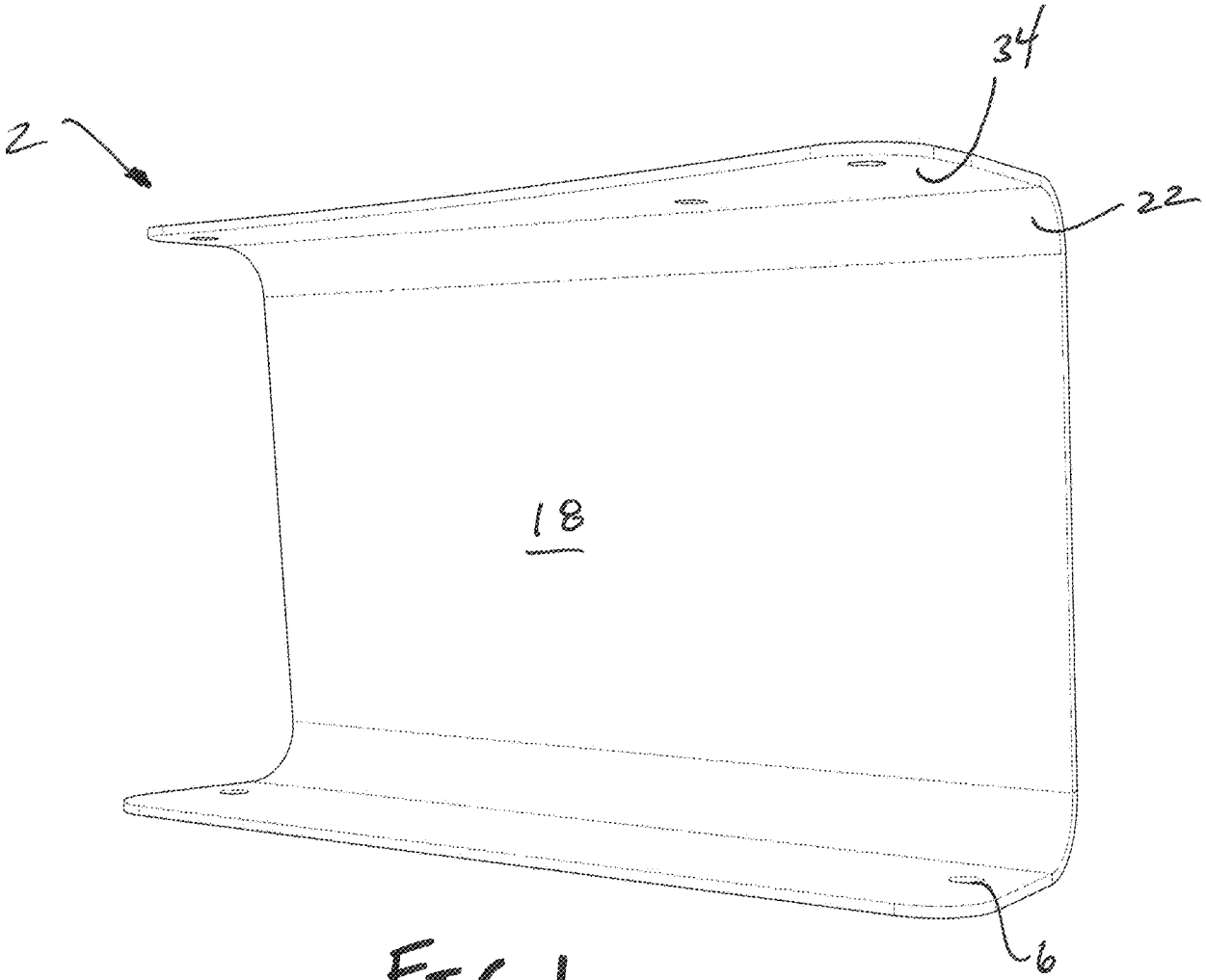
FIG. 1 is a perspective of the device of one embodiment of the present invention.
Figure 2:
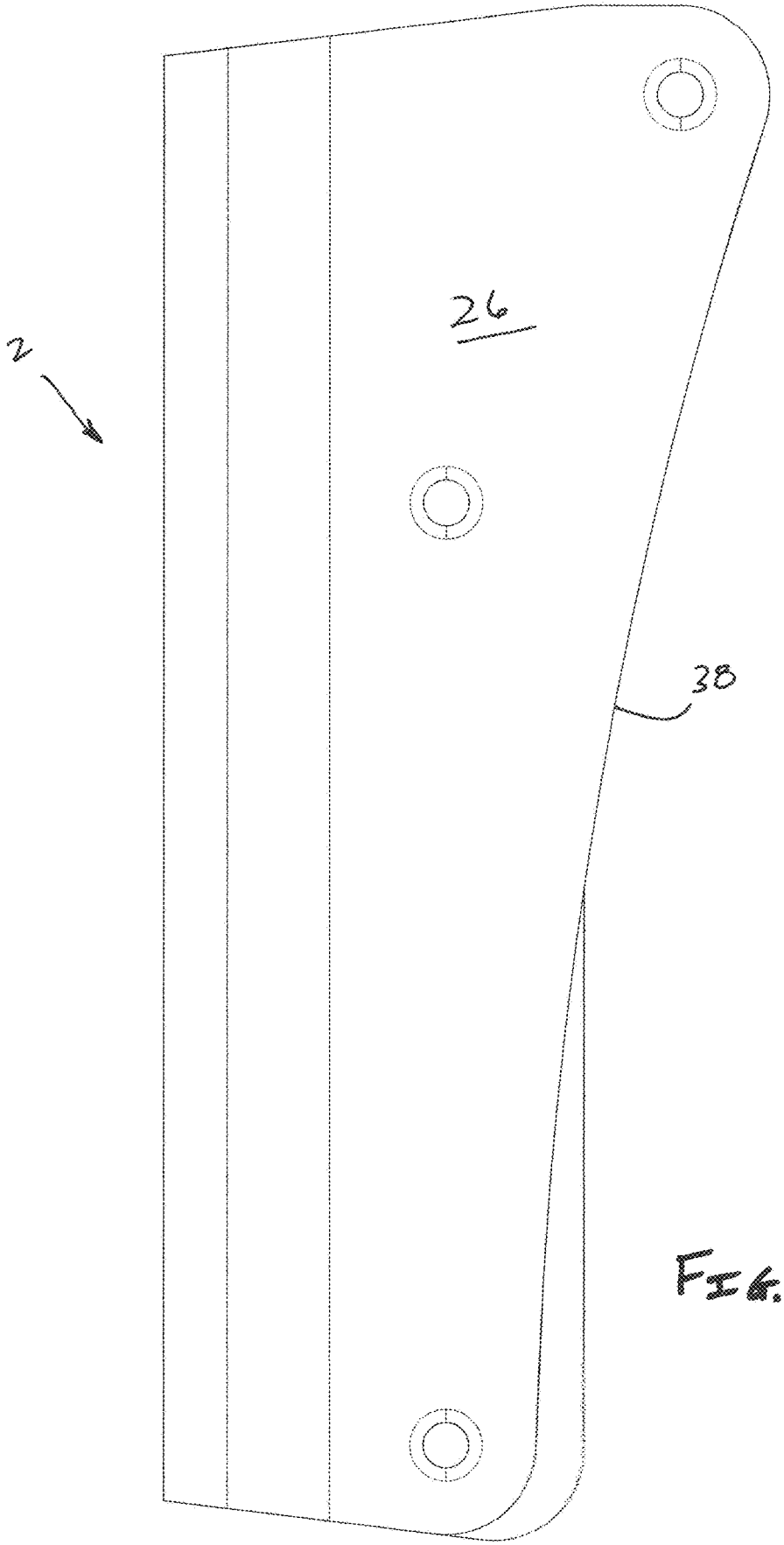
FIG. 2 is a top plan view of the device shown in FIG. 1.
Figure 3:
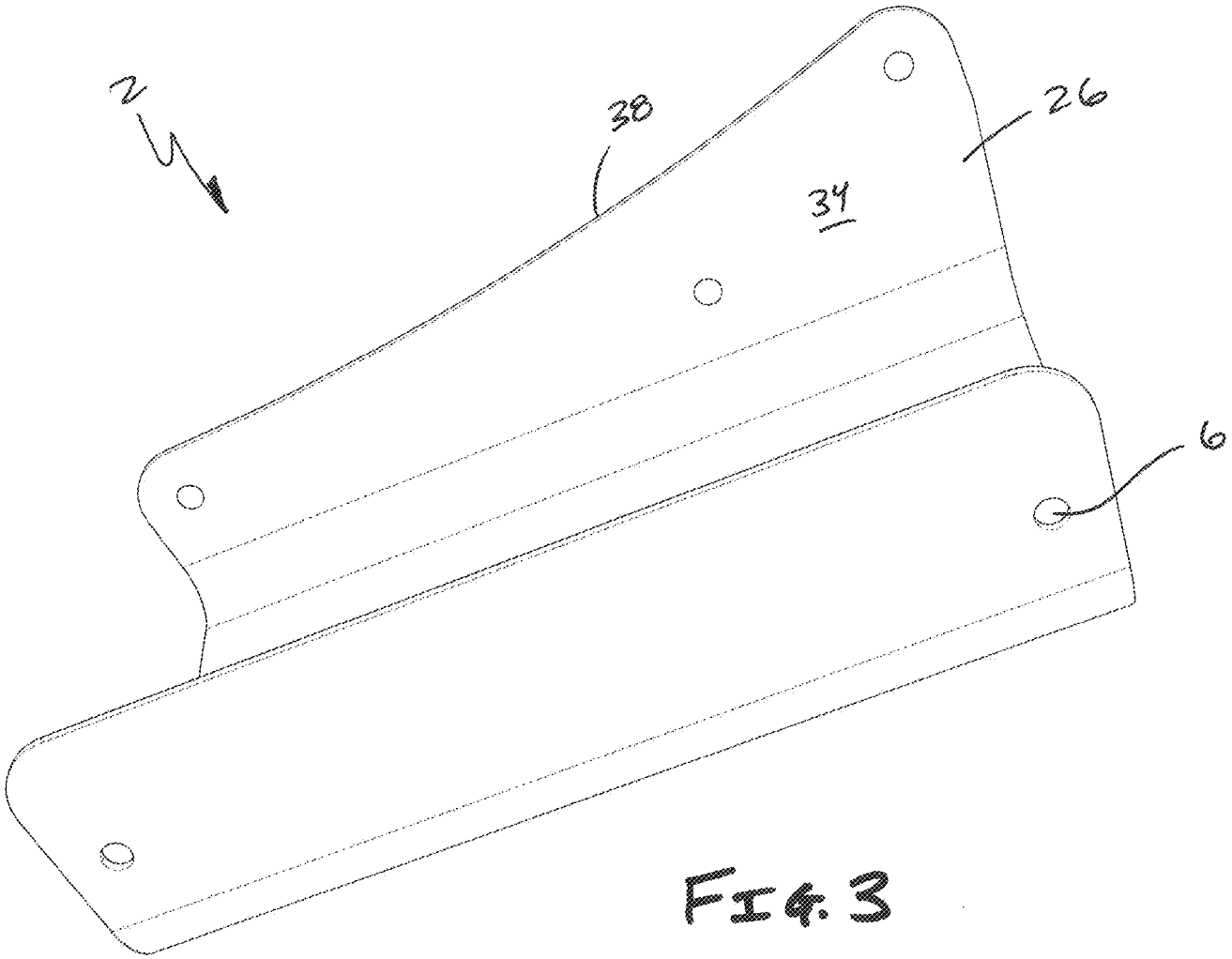
FIG. 3 is a bottom perspective view of the device shown in FIG. 1.
Figure 4:
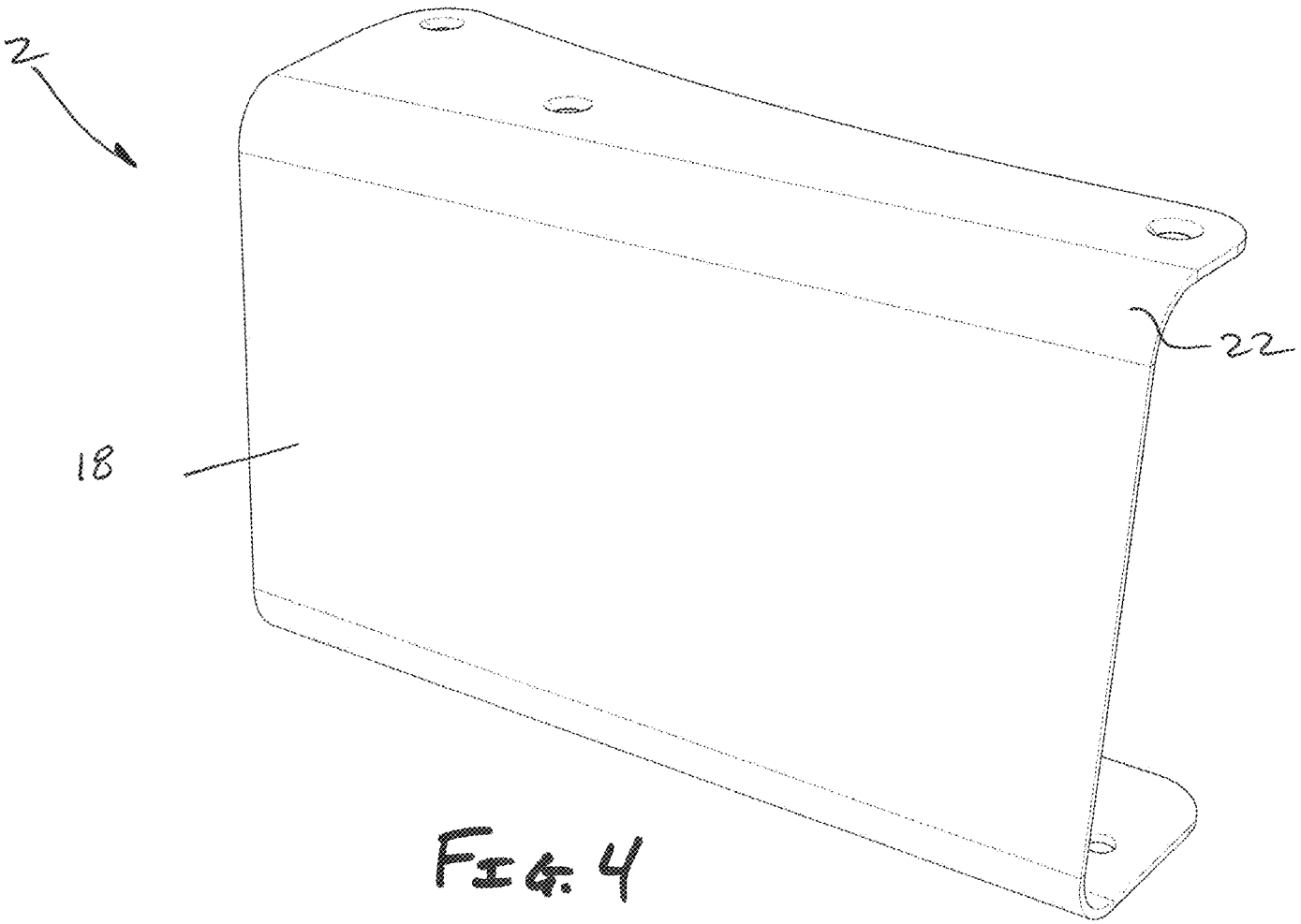
FIG. 4 is a side perspective view of the device shown in FIG. 1.
Figure 5:
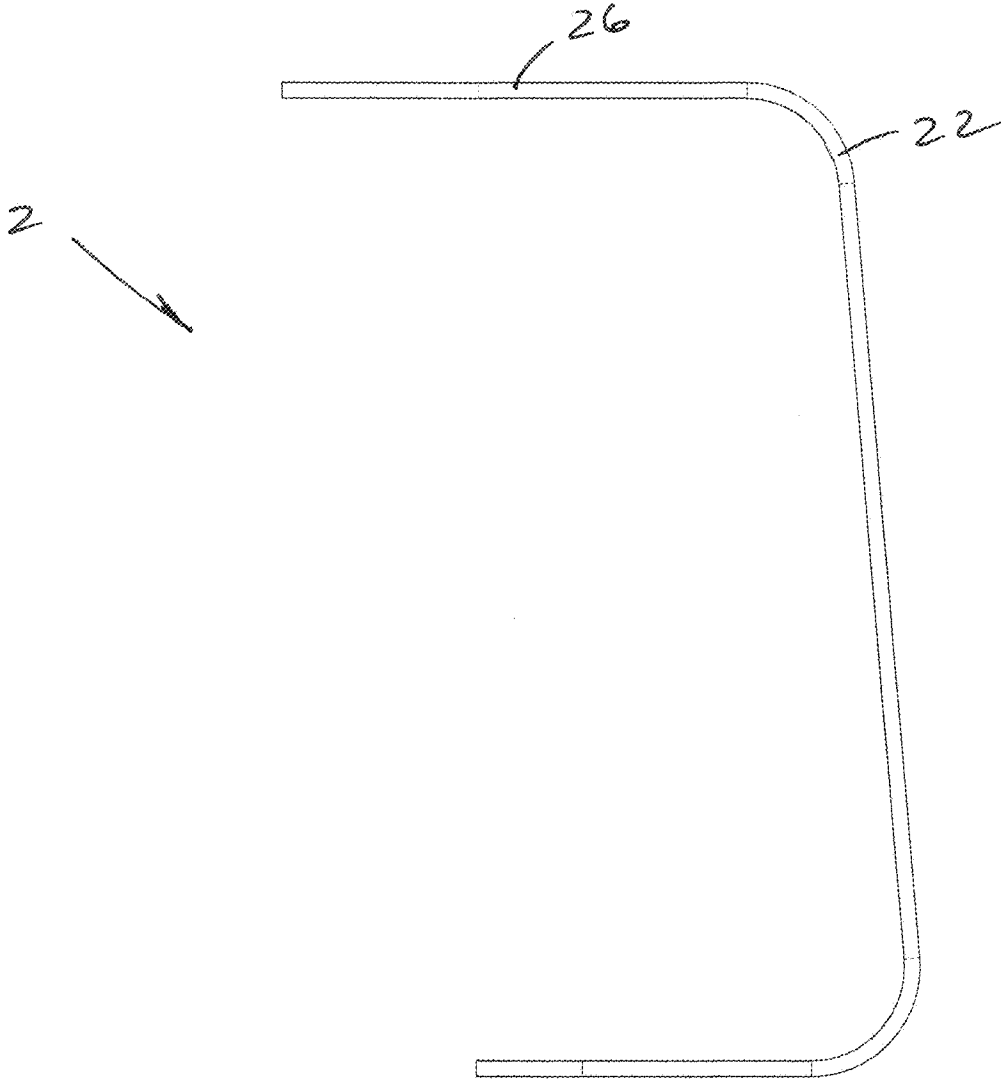
FIG. 5 is a front elevation view of the device shown in FIG. 1.
Figure 6:
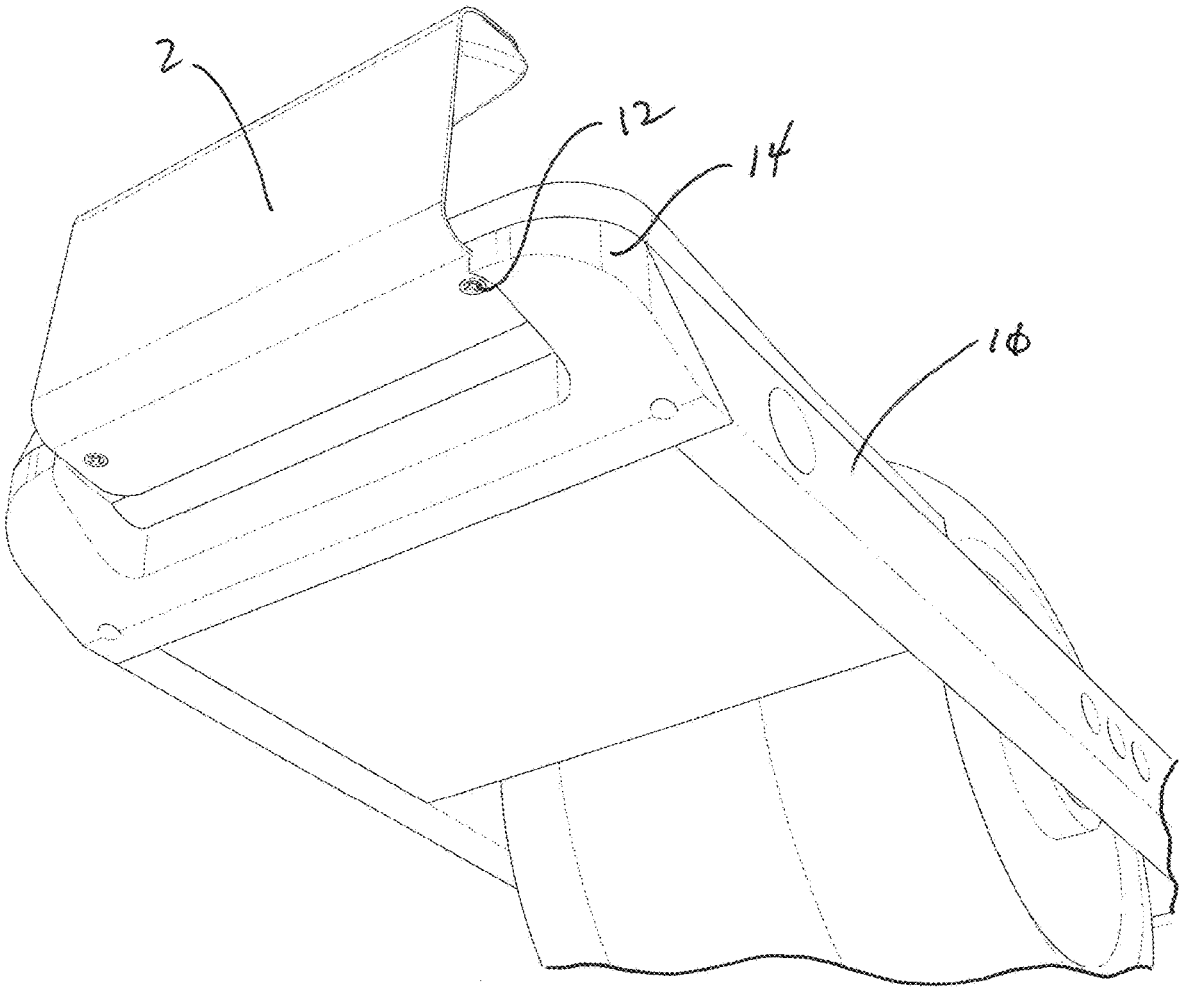
FIG. 6 is a bottom perspective view showing the device of FIG. 1 interconnected to a onewheel.
Figure 9:
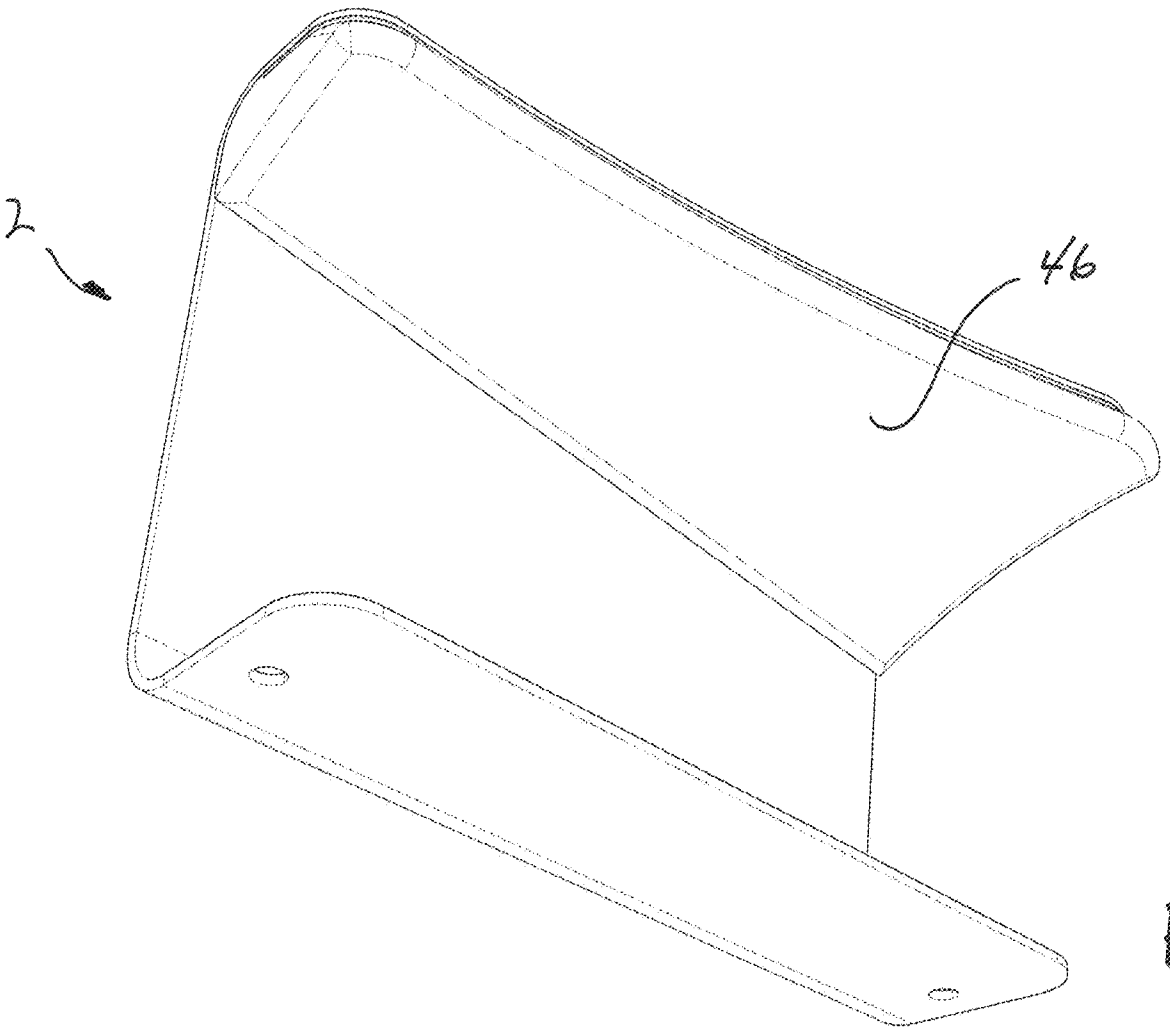
FIG. 9 is a top perspective view of the onewheel shown in FIG. 8.
Figure 8:
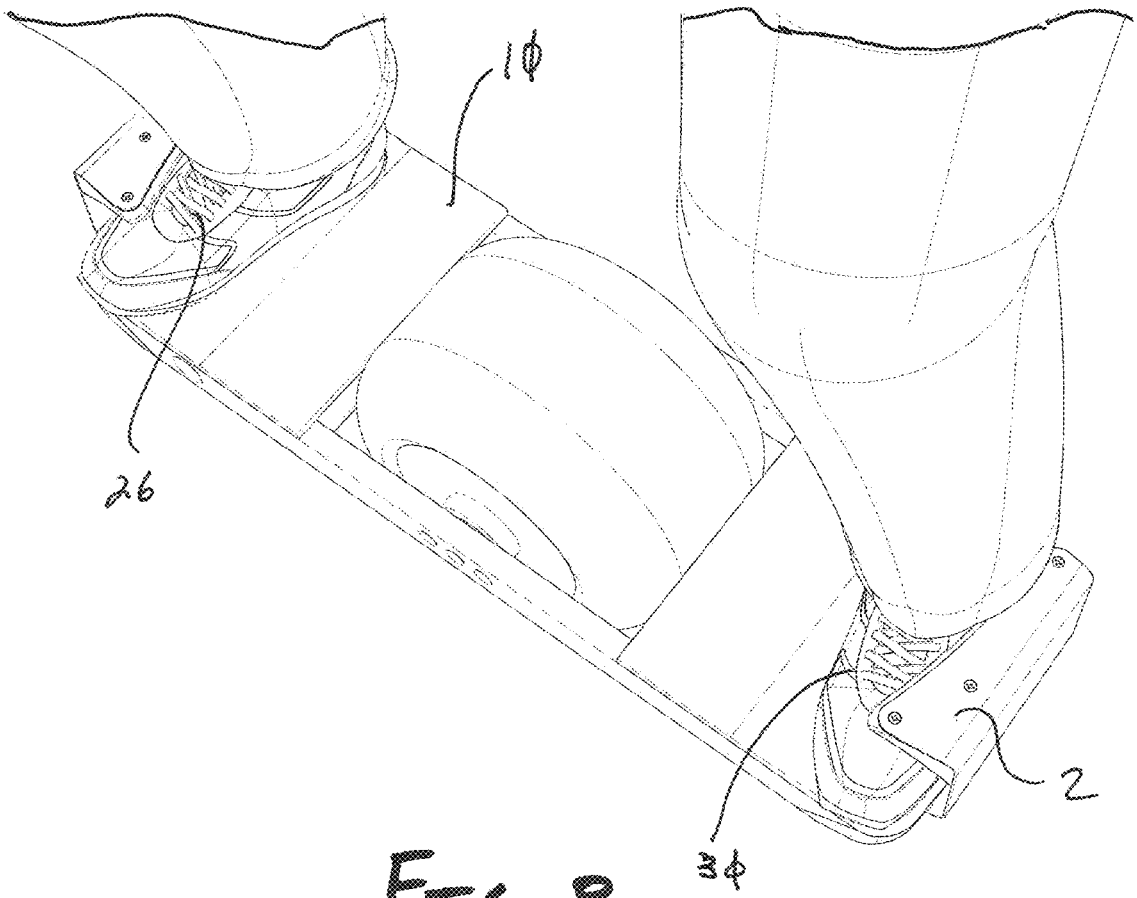
FIG. 8 is a top perspective view showing a rider using a onewheel with the rider's feet maintained by devices of FIG. 7.
Figure 9:
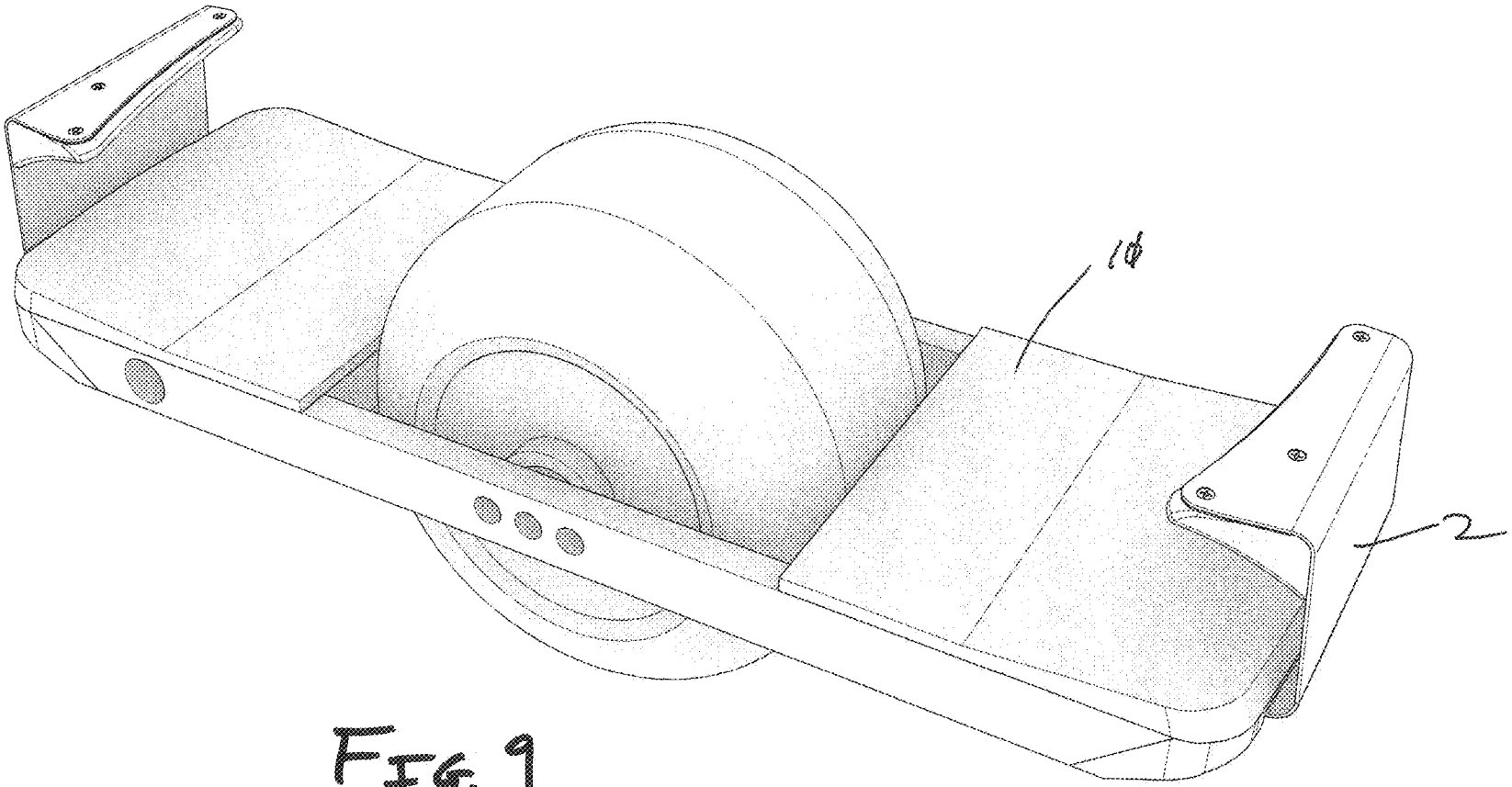
Figure 10:
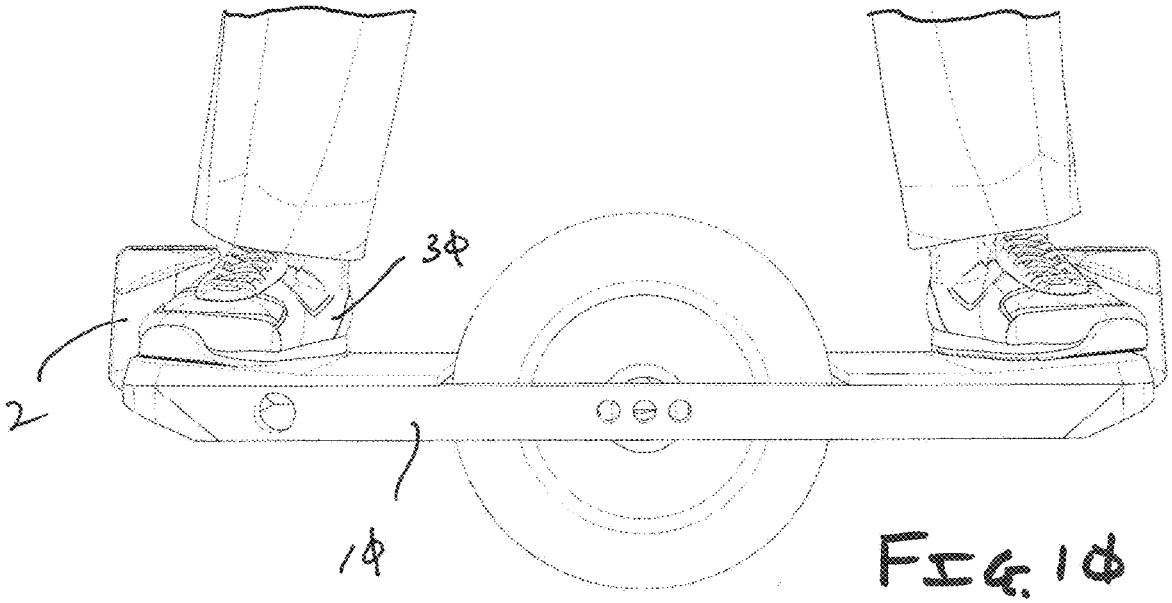
FIG. 10 is a front elevation view of the onewheel shown in FIG. 8.
Figure 11:
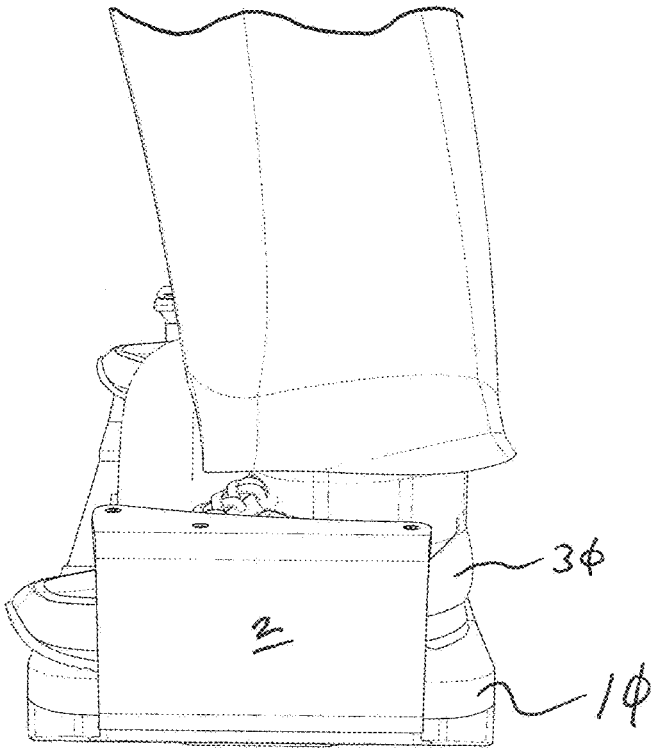
FIG. 11 is a side perspective view of the onewheel shown in FIG. 8.
Figure 12:
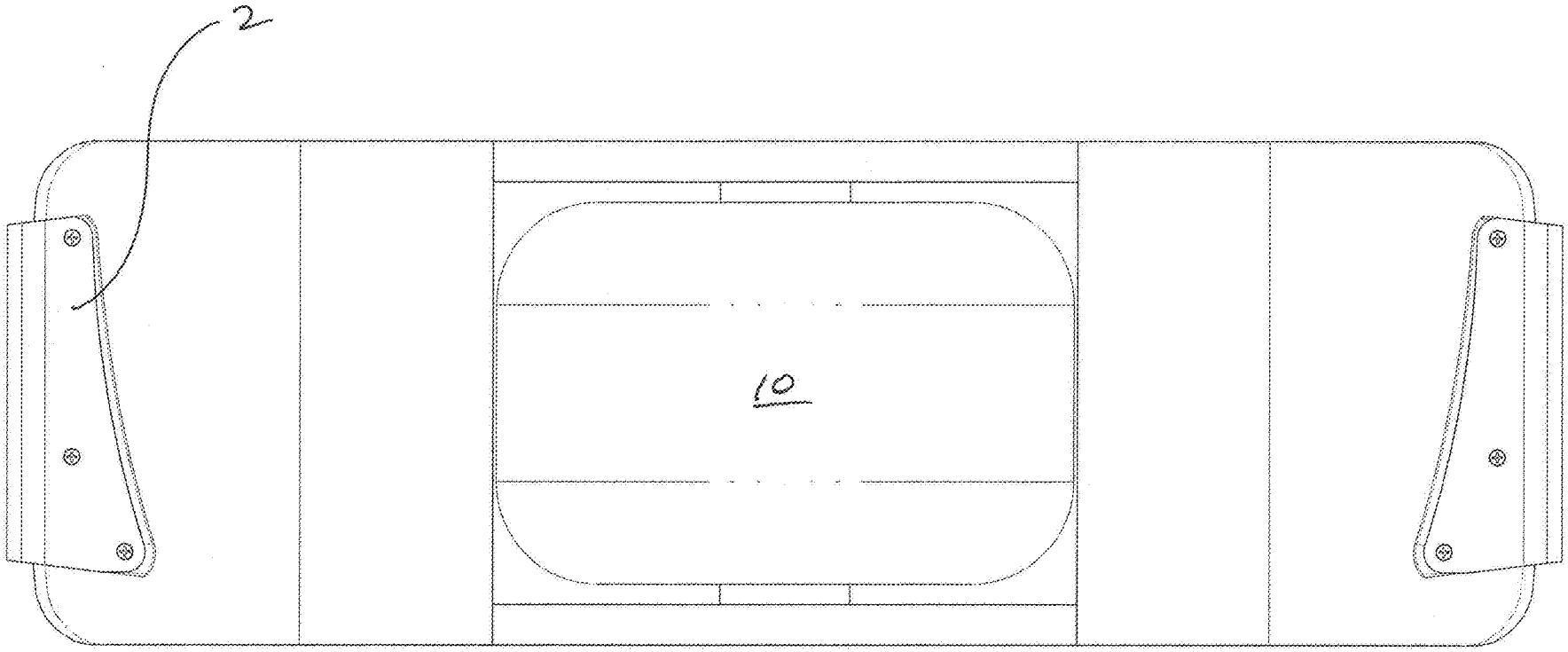
FIG. 12 is a top plan view of the onewheel shown in FIG. 8.
Figure 13:
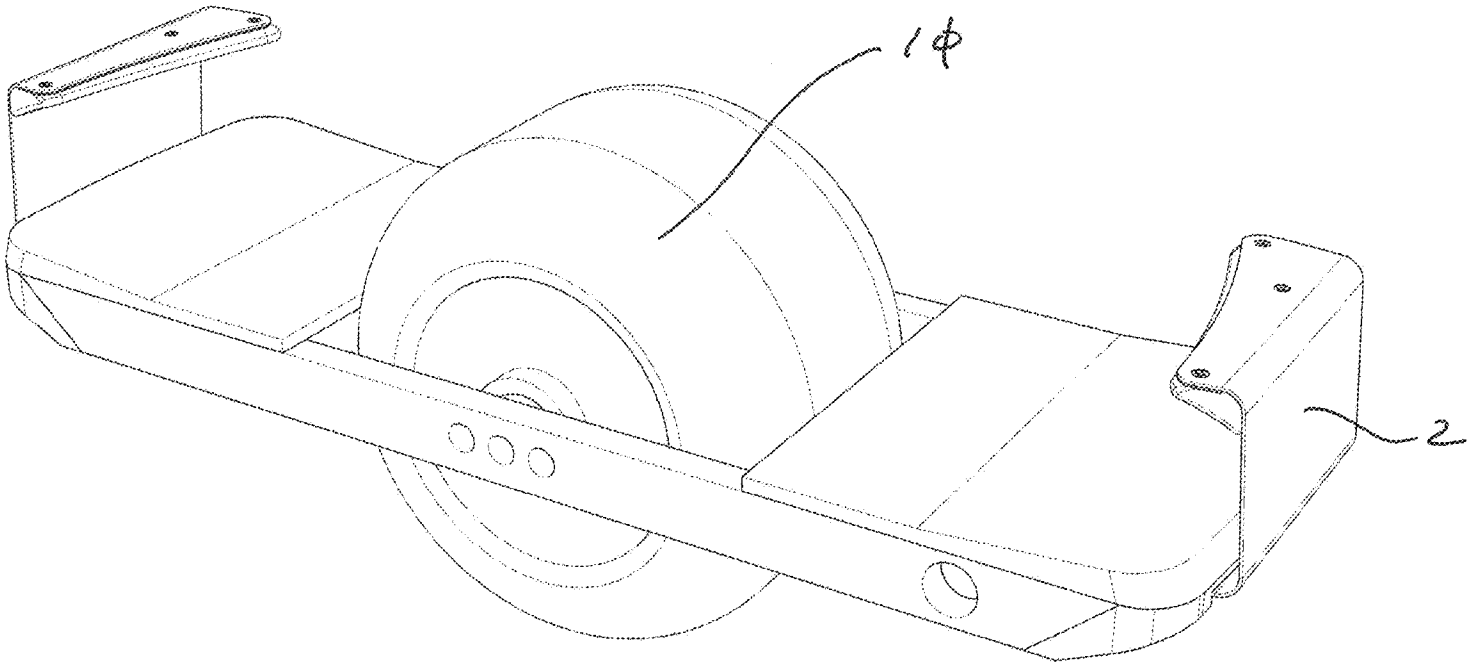
FIG. 13 is a rear perspective view of the onewheel shown in FIG. 8.

It should be understood that the drawings are not necessarily to scale. In certain instances, details which are not necessary for an understanding of the invention or which render other details difficult to perceive may have been omitted. It should be understood, of course, that the invention is not necessarily limited to the particular embodiments illustrated herein.

DETAILED DESCRIPTION

In general, onewheels comprise a centrally-oriented wheel portion bounded by front and rear portions, which terminate in respective front and rear edges, The device 2 of one embodiment of the present invention has holes 6 allowing for mounting to the onewheel 10 through existing bolt inserts 12 in the onewheel's bumper 14, although the device 2 is not limited to this method of mounting. The device 2 consists of a side 18 (also known as a "web" or "outer face"). A bend 22, curve, or otherwise inward transition of material (s) allows a topside 26 of the rider's foot 30 to engage with the underside 34 of the device's upper portion (also known as a "top flange") that is interconnected to one edge of the side. The device also includes a bottom portion (also known as a "bottom flange") that is interconnected to the side opposite the upper portion. An inward edge 38 of the top side(s) of the device may be shaped to conform to the general shape of a foot or may be straight. The device may consist of more than one material to retain structural integrity while reducing the potential for damage to the rider's shoes or feet. For example, the underside may include a pad 46.

Exemplary characteristics of embodiments of the present invention have been described. However, to avoid unnecessarily obscuring embodiments of the present invention, the preceding description may omit several known apparatus, methods, systems, structures, and/or devices one of ordinary skill in the art would understand are commonly included with the embodiments of the present invention. Such omissions are not to be construed as a limitation of the scope of the claimed invention. Specific details are set forth to provide an understanding of some embodiments of the present invention. It should, however, be appreciated that embodiments of the present invention may be practiced in a variety of ways beyond the specific detail set forth herein.

Modifications and alterations of the various embodiments of the present invention described herein will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. That is, the embodiments of the invention described herein are capable of being practiced or of being carried out in various ways. The scope of the various embodiments described herein is indicated by the following claims rather than by the foregoing description. And all changes which come within the meaning and range of equivalency of the claims are to be embraced within their scope. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The foregoing disclosure is not intended to limit the invention to the form or forms disclosed herein. In the foregoing Detailed Description, for example, various features of the invention are grouped together in one or more embodiments for the purpose of streamlining the disclosure. This method of disclosure is not to be interpreted as reflecting an intention that the claimed inventions require more features than expressly recited. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention. Further, the embodiments of the present invention described herein include components, methods, processes, systems, and/or apparatus substantially as depicted and described herein, including various sub-combinations and subsets thereof. Accordingly, one of skill in the art will appreciate that would be possible to provide for some features of the embodiments of the present invention without providing others. Stated differently, any one or more of the aspects, features, elements, means, or embodiments as disclosed herein may be combined with any one or more other aspects, features, elements, means, or embodiments as disclosed herein.

What is claimed is:

1. A device associated a single wheel motorized board having a front edge, a wheel portion, and a rear edge, comprising:

a lower portion having an upper surface configured to interconnect to the front edge or rear edge of the board;

a web interconnected to the lower portion, the web having an inward surface configured to be located adjacent to the front edge or rear edge of the board and adapted to engage an outer portion of a user's foot; and an upper portion having an inner edge extending towards the wheel portion of the board and generally perpendicular to the web.

2. The device of claim 1, wherein the inner edge of the upper portion is curved, wherein a first end of the inner edge, which is associated with a first lateral toe-side edge of the board, is longer than a second end of the inner edge, which is associated with a lateral heal-side edge.

3. The device of claim 1, wherein the web is angled relative to the lower portion and the upper portion.

4. The device of claim 1, wherein the lower portion resides in a cavity of a bumper associated with the front edge or rear edge of the board.

5. The device of claim 1, wherein the upper portion has a lower surface that faces an upper surface of the board.

6. The device of claim 5, further comprising a pad interconnected to the lower surface of the upper portion.

7. The device of claim 1, wherein no portion of the lower portion attaches to an upper surface of the board.

8. The device of claim 1, wherein no portion of the web is located between the front edge or rear edge and a midpoint of the board.

9. A onewheel, comprising:

a rear edge, first lateral toe-side, a lateral heal-side edge defining an upper surface and a lower surface;

a single wheel positioned in an opening provided at the midpoint of the upper surface and the lower surface, the wheel having lateral surfaces corresponding to lateral heal-side and toe-side edges of the onewheel;

a front foot retention member associated with the front edge, comprising:

a lower portion having an upper surface configured to interconnect to the front edge of the onewheel, a web interconnected to the lower portion, the web having an inward surface configured to be located adjacent to the front edge of the onewheel and adapted to engage an outer portion of a user's first foot, and an upper portion having an inner edge extending towards the wheel, the upper portion having a lower surface that faces the upper surface of the onewheel;

a rear foot retention member associated with the rear edge, comprising:

a lower portion having an upper surface configured to interconnect to the rear edge of the onewheel, a web interconnected to the lower portion, the web having an inward surface configured to be located adjacent to the rear edge of the onewheel and adapted to engage an outer portion of a user's second foot, and an upper portion having an inner edge extending towards the wheel, the upper portion having a lower surface that faces the upper surface of the onewheel;

wherein application of a force onto the lower surface of the upper portion of the front foot retention member while pressing down on a rear portion of the onewheel adjacent to the rear edge rotates the front edge of the onewheel upwardly;

wherein application of a force onto the lower surface of the upper portion of the rear foot retention member while pressing down on a front portion of the onewheel adjacent to the front edge rotates the front edge of the onewheel upwardly; and wherein application of a force onto the lower surfaces of the upper portions of the front and rear foot retention members will initiate a vertical lift maneuver.

10. The device of claim 9, wherein the inner edges of the upper portions are curved, wherein first ends of the inner edges that are associated with the lateral toe-side edge of the onewheel is longer than second ends of the inner edges that are associated with the lateral heal-side edge.

11. The device of claim 9, wherein the webs are angled relative to the lower portions and the upper portions.

12. The device of claim 9, wherein the lower portions reside in cavities of bumpers associated with the front edge or rear edge of the onewheel.

13. The device of claim 9, further comprising pads interconnected to the lower surfaces of the upper portions.

14. The device of claim 9, wherein no portion of the lower portions attach to the upper surface of the onewheel.

15. The device of claim 9, wherein no portion of the webs are located between the front edge or rear edge and the wheel.

16. A device associated with an electrically powered, self-balancing, sideways-operated single-wheel motorized board having a front portion, a wheel portion, and a rear portion, comprising:

a bottom flange having an upper surface configured to interconnect to the front portion or rear portion of the one wheel;

a web interconnected on one end to the bottom flange, the web having an inner surface configured to be located adjacent to the front portion or rear portion of the one-wheel board and adapted to engage the outer portion of a user's foot; and a top flange interconnected to the web at an end opposite to the bottom flange, the top flange having an edge extending inward toward the wheel portion of the board.

17. The device of claim 16, wherein an inward extending edge of the top flange is curved, and wherein the inward extending edge is adapted to be associated with an antero-posterior axis of a user's ankle, and wherein a first end of the inward extending edge is associated with a lateral toe-side edge of the board, which is longer than a second end of the inward extending edge, that is associated with a lateral heel-side edge of the one-wheel board.

18. The device of claim 16, wherein the web is angled relative to the top flange and the bottom flange.

19. The device of claim 16, wherein the bottom flange resides in a cavity of a bumper associated with the front edge or rear edge of the board.

20. The device of claim 16, wherein the top flange has a lower surface that faces an upper surface of the one-wheel.

* * * * *